US006440227B1

(12) United States Patent
Berfield et al.

(10) Patent No.: US 6,440,227 B1
(45) Date of Patent: Aug. 27, 2002

(54) NOZZLE AND METHOD PROVIDING INCREASED LIQUID LIFT HEIGHT FOR A WET/DRY VACUUM CLEANER

(75) Inventors: Robert C. Berfield, Jersey Shore; Alan Kaufman, South Williamsport, both of PA (US)

(73) Assignee: Shop-Vac Corporation, Williamsport, PA (US)

( * ) Notice: Subject to any disclaimer, the term of this patent is extended or adjusted under 35 U.S.C. 154(b) by 0 days.

(21) Appl. No.: 09/627,840

(22) Filed: Jul. 28, 2000

(51) Int. Cl.[7] ..... A47L 9/02
(52) U.S. Cl. ..... 134/21; 15/421
(58) Field of Search ..... 15/421, 415.1; 134/21

(56) References Cited

U.S. PATENT DOCUMENTS

| | | | | |
|---|---|---|---|---|
| 683,874 A | | 10/1901 | Atkins | |
| 1,106,231 A | * | 8/1914 | Marshall | 15/421 X |
| 2,096,595 A | * | 10/1937 | Sanford | 15/421 |
| 2,433,408 A | | 8/1947 | Tollefsen | |
| 2,449,596 A | | 9/1948 | Ericson | |
| 2,476,425 A | * | 7/1949 | McLeary | 15/421 X |
| 4,023,233 A | | 5/1977 | Prestwich | |
| 4,864,681 A | | 9/1989 | Hult et al. | |
| 5,080,560 A | | 1/1992 | LeRoy et al. | |
| 5,252,025 A | | 10/1993 | Kida et al. | |
| 5,349,722 A | | 9/1994 | Chayer | |
| 5,797,161 A | * | 8/1998 | Campbell | 15/421 X |

FOREIGN PATENT DOCUMENTS

| | | | | |
|---|---|---|---|---|
| AT | 42445 | * | 5/1910 | 15/421 |

* cited by examiner

*Primary Examiner*—Chris K. Moore
(74) *Attorney, Agent, or Firm*—Marshall, Gerstein & Borun

(57) ABSTRACT

A vacuum cleaner capable of collecting wet or dry media includes a hose having an inlet end and an outlet end that is coupled to the vacuum cleaner. A motor is supported by a portion of the vacuum cleaner and applies a vacuum to the outlet end of the vacuum hose. A media inlet is positioned near the inlet end of the vacuum hose. An air intake for admitting air into the vacuum hose is provided near the media inlet. The air intake can be adapted to receive a detachable separate device in order to provide an air intake that is remotely positioned from the media inlet. Alternatively, the air intake can be provided on an attachment to or an integral part of the vacuum hose for providing the air intake at a remote distance from the media inlet. A distal end of the vacuum hose is immersed in a liquid to be collected so that the media inlet is immersed in the liquid and so that the air intake is exposed to a source of air. A vacuum is applied to the vacuum hose to collect the liquid through the media inlet while air is simultaneously drawn via the air intake into the vacuum hose and mixed with the collected liquid to increase the liquid lift height capability of the vacuum cleaner.

26 Claims, 9 Drawing Sheets

NOZZLE AND METHOD PROVIDING INCREASED LIQUID LIFT HEIGHT FOR A WET/DRY VACUUM CLEANER

FIELD OF THE INVENTION

The present invention relates generally to vacuum cleaners capable of collecting a wet or a dry media, and more particularly to a vacuum cleaner having a nozzle adapted to increase the liquid lift height capability of a vacuum cleaner when collecting a wet media.

BACKGROUND OF THE INVENTION

Wet/dry vacuum cleaners are designed to collect both a dry media such as dirt, dust and the like and a wet media or liquid such as water. The distal end or inlet end of the vacuum hose is simply immersed in the liquid to be collected. The liquid is drawn into the vacuum hose and most often is collected in a tank of the vacuum cleaner.

A wet/dry vacuum cleaner is often used to vacuum up small spills or puddles which typically require very little sealed suction capability of the vacuum cleaner. Under these circumstances, the water or other liquid is lifted easily by the vacuum because the total volume of liquid is relatively low under these circumstances. The suction capacity of the vacuum cleaner motor and/or impeller limits the vertical lift height of a solid column of liquid. However, under these circumstances, the column of liquid would be relatively small or absent altogether.

As an example, a maximum suction capacity of a vacuum cleaner is limited by the type and number of air impellers disposed in the vacuum cleaner housing. A vacuum cleaner capable of producing a vacuum of 50 inches of water (in. $H_2O$) would be capable of lifting a solid column of water in the vacuum hose about 50 inches vertically.

A wet/dry vacuum cleaner is sometimes used to clean out or pick up liquid spills in relatively large areas. For example, during storms basements can flood leaving several inches or more of water behind. To clean up and collect the water using a wet/dry vacuum, the vacuum tank is placed above the basement floor surface such as at the top of a set of stairs. The vacuum hose is extended down the stairs with the inlet or media collecting end immersed in the water. If the stairs rise vertically about eight feet above the basement floor and the vacuum cleaner capacity is only 50 in. $H_2O$, the vacuum cleaner will not be able to lift and collect the water from the basement to the tank.

U.S. Pat. No. 2,433,408 to Tollefsen and U.S. Pat. No. 2,449,596 to Ericson each disclose a sludge pumping system for lifting sludge form a low elevation to a high elevation collector. Each system has a hose with a nozzle immersed in the sludge. The nozzle has an opening near the end for admitting air into the sludge in order to improve the lift height capability. The nozzle disclosed in each of these patents is not for a wet/dry vacuum and must be carefully placed and monitored so as not to immerse the air inlet opening in the sludge.

U.S. Pat. No. 5,252,025 to Kida et al. discloses a drainage pump that has a liquid inlet in an impeller housing. The housing also has one or more first air inlets positioned a short distance above the inlet. The housing further has one or more tubes affixed to the housing that define one or more second air inlets positioned higher than the first air inlets. The housing is held in a fixed position and the air inlets admit air into the housing under various liquid level conditions relative to the housing.

SUMMARY OF THE INVENTION

What is needed is an apparatus and method to improve the vertical liquid lift height of a conventional wet/dry vacuum cleaner without significantly increasing the cost of the machine or significantly altering the motor and related components. What is also needed is such a method and apparatus that is adaptable for different vacuum jobs and is simple to use for each type of job.

Features and advantages of the teachings of the present invention are achieved by the nozzle apparatus and method described herein. In a disclosed example, a vacuum cleaner that is capable of collecting a wet or a dry media includes a vacuum hose having an inlet and having an outlet end coupled to the vacuum cleaner. A motor is supported by a portion of the vacuum cleaner for applying a vacuum to the outlet end of the vacuum hose. The vacuum cleaner also has a media inlet for directing a media to be collected into the vacuum hose near the inlet end of the vacuum hose. The vacuum cleaner also has an air intake for admitting air into the vacuum hose near the media inlet.

In another disclosed example, a nozzle section is carried on the inlet end of the hose and defines the media inlet and also defines the air intake spaced a distance away from the media inlet.

In another disclosed example, the nozzle section is selectively detachable and connectable to the inlet end of the vacuum hose.

In another disclosed example, the nozzle section also has an elongate tube extending from a portion of the section. The tube has a passage in fluid communication with the vacuum hose and also has a distal end that defines the air intake. In another disclosed example, the elongate tube and the nozzle section are integrally formed as a one-piece unitary structure. In an alternative disclosed example, the elongate tube is selectively removable from and insertable into an opening in the nozzle section.

In another disclosed example, the vacuum cleaner has a nozzle section carried on the inlet end of the vacuum hose. The nozzle section has a distal end that defines the media inlet and has an air intake carried on the nozzle section spaced a distance from the media inlet. In another disclosed example, the nozzle section and the vacuum hose are formed as an integral one-piece unitary structure. In an alternative disclosed example, the nozzle section can be selectively removed from or attached to the inlet end of the vacuum hose.

In another disclosed example, the air intake of the nozzle section has an opening through a wall of the nozzle section and a coupling mechanism that cooperates with the opening for selectively attaching, removing and/or replacing a separate device to the air intake.

In another disclosed example, the separate device attachable to the air intake can include a closure seal to close off the air intake. In another disclosed example, the separate device can include a removable secondary elongate hose to provide a remote air intake in fluid communication with the opening of the air intake.

In another disclosed example, the coupling mechanism cooperating with the opening of the air intake includes a plurality of first mechanical threads provided adjacent the opening of the nozzle section. A plurality of second mechanical threads are provided on the separate device wherein the second mechanical threads cooperate with the first mechanical threads for attaching and removing the separate device from the nozzle section.

In another disclosed example, the vacuum cleaner also includes an air flow controller coupled to the air intake for controlling the amount of air entering the vacuum hose through the air intake near the media inlet.

In another disclosed example of the teachings of the present invention, a nozzle section for an inlet end of a vacuum hose of a wet/dry vacuum cleaner includes a first end that communicates with the inlet end of the vacuum hose. The nozzle section also has a distal end opposite the first end that defines the media inlet for directing the media to be collected into the vacuum hose. The nozzle section further has an air intake carried on the section and spaced a distance from the media inlet. A coupling mechanism is provided that cooperates with the air intake for selectively attaching, removing and replacing a separate device relative to the air intake.

In another disclosed example, the nozzle section and the vacuum hose are formed as discrete separate components so that the nozzle section can be removed if desired from the vacuum hose.

In another disclosed example, the coupling mechanism of the nozzle section includes a plurality of first mechanical threads carried on a portion of the air intake. The separate device also includes a plurality of second mechanical threads that cooperate with the first mechanical threads so that the separate device can be attached or removed from the vacuum hose as desired.

In another disclosed example, the separate device can include a closure seal to close off the air intake. In another disclosed example, the separate device can also include a removable secondary elongate hose to provide a remote air intake in fluid communication with the air intake of the nozzle section.

In another disclosed example of the teachings of the present invention, a nozzle section for an inlet end of a vacuum hose of a wet/dry vacuum cleaner includes a first end that communicates with the inlet end of the vacuum hose. The nozzle section has a distal end opposite the first end that defines a media inlet for directing media to be collected into the vacuum hose. The nozzle section also has an elongate tube that has one end connected to the housing wherein the elongate tube extends from the nozzle section. The nozzle section also includes a distal end opposite and spaced from the one end. The section further has an air intake formed in the distal end that is in fluid communication with the vacuum hose via the elongate tube and the nozzle section.

In another disclosed example, the nozzle section is molded as a one-piece integral structure and is selectively detachable and connectable to the inlet end of the vacuum hose.

In another disclosed example of the teachings of the present invention, a method of collecting a liquid with a wet/dry vacuum cleaner is provided. The vacuum cleaner has an elongate vacuum hose extending from the vacuum cleaner, a media inlet on a distal end of the vacuum hose, and a motor supported by a portion of the vacuum cleaner for applying a vacuum to the vacuum hose. An air intake is provided for admitting air into the vacuum hose near the media inlet. The distal end of the vacuum hose is then immersed in the liquid to be collected so that the media inlet is received in the liquid and so that the air intake is exposed to atmospheric air. A vacuum is then applied to the vacuum hose to collect the liquid through the media inlet while drawing air via the air intake into the vacuum hose so that the air mixes with the collected liquid.

These and other features and advantages of the teachings of the present invention will become apparent upon a review of the detailed description and accompanying drawings. Though particular examples of the present invention are disclosed, the invention is not to be so limited. Changes and modifications can be made to the examples disclosed herein and yet fall within the scope and spirit of the invention.

DESCRIPTION OF THE PREFERRED EMBODIMENTS

Figure 1:
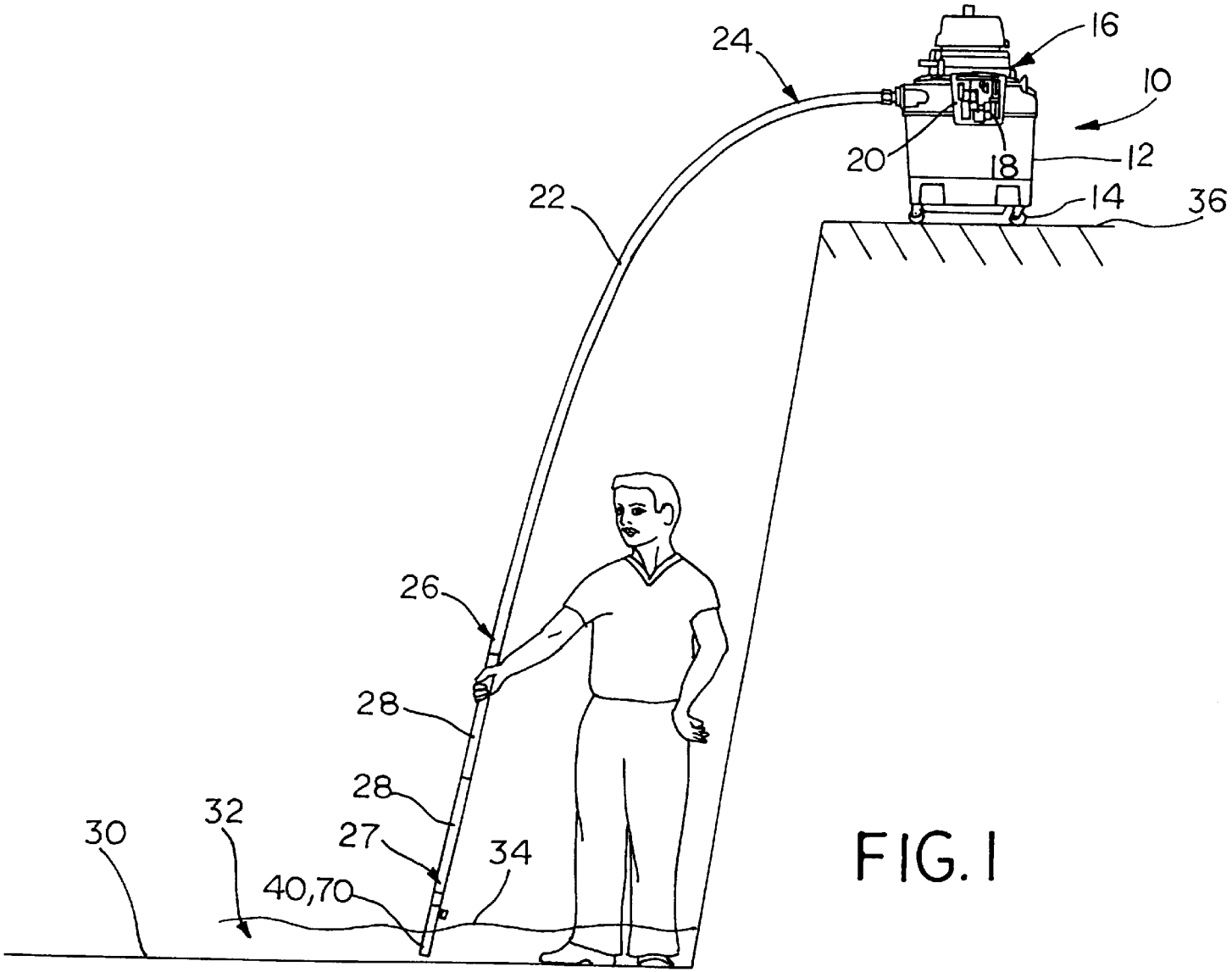
FIG. 1 is a perspective view of a wet/dry vacuum cleaner in accordance with the present invention.

Referring now to the drawings, FIG. 1 illustrates a perspective view of a wet/dry vacuum cleaner in accordance with the teachings of the present invention and utilized in an exemplary manner suitable for the present invention. A vacuum cleaner 10 typically includes a canister or tank 12 for storing a media collected by the vacuum cleaner. The tank is typically mounted on wheels or casters 14 so that the vacuum cleaner can be easily maneuvered. A motor assembly 16 is typically carried on a top portion of the tank 12. The motor assembly 16, though not an important feature of the present invention, typically includes a housing and one or more impellers for creating a vacuum or suction within the vacuum hose, as is known in the art. The motor assembly 16 includes a motor 18 that is typically protected by a filter 20 surrounding an intake side of the motor for protecting the motor from the contents or media collected.

In general, the vacuum cleaner 10 also includes a vacuum hose 22 extending from a portion of the vacuum cleaner. The vacuum hose 22 has an outlet end 24 that is positioned near the vacuum cleaner 10 for discharging the media collected to the tank. The vacuum hose 22 also has an inlet end 26 at a distal end of the hose. An alternative inlet end 27 can be defined by adding one or more extension sections 28 to the inlet end 26 of the hose itself. As shown in FIG. 1, most vacuum cleaners come equipped with a plurality of different detachable and interchangeable nozzle 29 attachable either to the inlet end of the hose 26 or to the inlet 27 of one of the extensions 28. These interchangeable extensions 28 and various nozzles 29 render most vacuum cleaners relatively versatile. The vacuum cleaner 10 may also have an internal pump (not shown) for removing liquid matter from the tank 12. Such a vacuum cleaner is disclosed in co-owned U.S. co-pending patent application Ser. No. 09/383,351, filed Aug. 26, 1999, which is incorporated herein by reference.

The vacuum cleaner 10 illustrated in FIG. 1 is shown being utilized in a manner appropriate for the teachings of the present invention. A floor surface 30 is illustrated covered by a relatively large amount of a liquid 32 having a liquid top surface 34 that defines the depth of the liquid. As shown, the vacuum cleaner 10 is supported on a surface 36 that is elevated relative to the floor surface 30. The hose 22 extends downward from the vacuum cleaner to near the floor surface in order to collect the liquid 32. A number of examples of an apparatus and a method are disclosed herein for lifting the liquid 32 to the vacuum cleaner 10 beyond the normal lifting capability of the motor assembly 16. For example, the motor assembly 16 may be capable of lifting a solid column of liquid such as water over a vertical distance of 50 inches determined by the maximum vacuum capability of the motor assembly. In FIG. 1, the distance between the floor surface 30 and the elevated surface 36 is often much greater than 50 inches, for example on the order of nine feet or one hundred and eight inches.

Figure 2A:
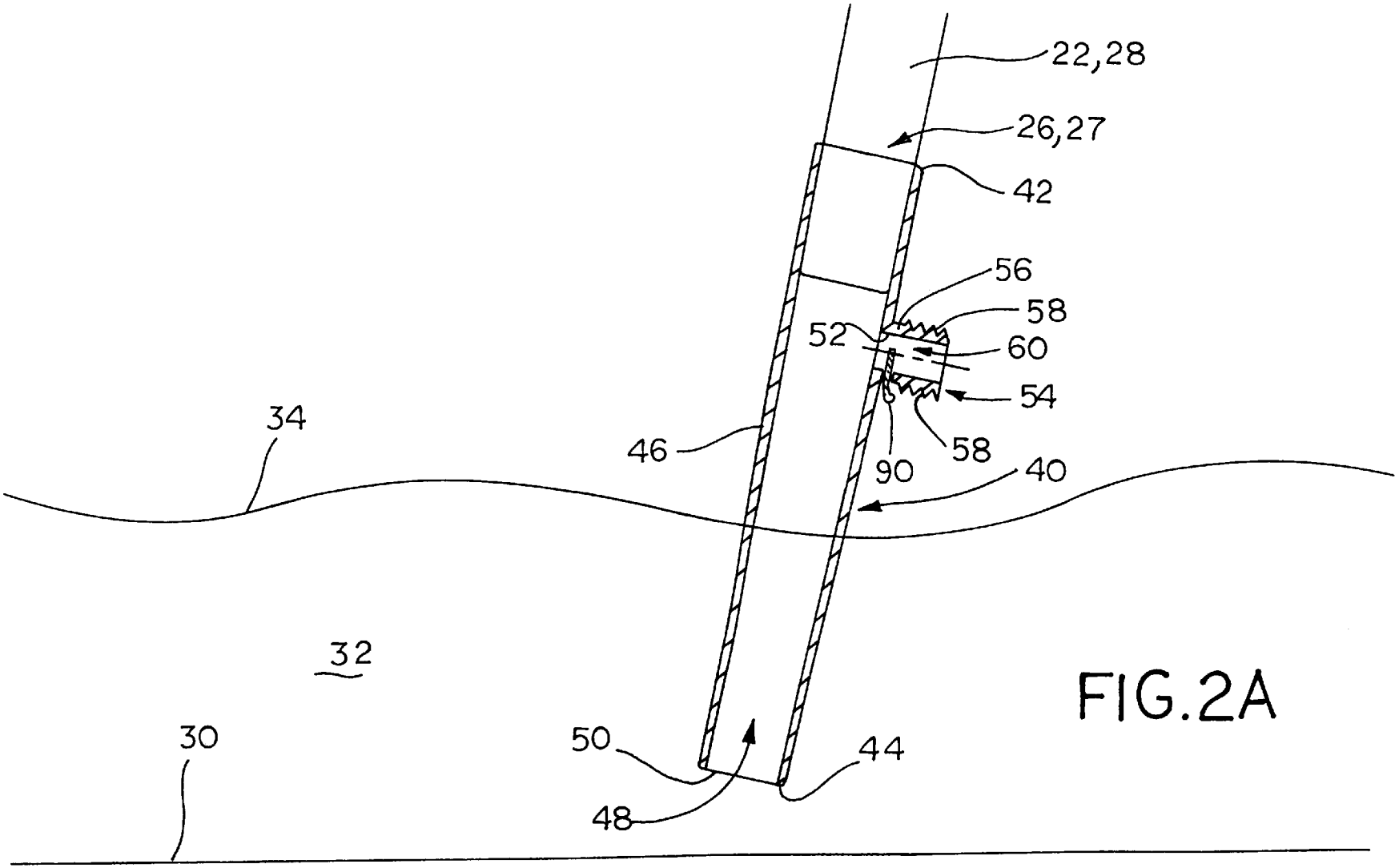
FIG. 2A is an enlarged view of a nozzle section attached to an inlet end of the vacuum hose for the vacuum cleaner in FIG. 1.

FIG. 1 generally illustrates a nozzle section 40 adapted for attachment to an inlet end 26 of the vacuum hose 22 or an inlet end 27 of an extension section 28 for the hose. As shown in FIG. 2A, the nozzle section 40 has a first or proximal end 42 that is removably attached to the inlet end 26 or 27 of the vacuum hose 22 or the extension 28, respectively, in a suitable known manner. The nozzle section 40 also has a second or distal end 44 opposite the proximal end 42 and an annular wall 46 extending between the two ends defining a passage 48 within the nozzle section. The distal end 44 defines a media inlet 50 through which a media such as the liquid 32 is collected and directed to the vacuum hose 22.

The nozzle section 40 includes an opening 52 in the annular wall 46 that also communicates with the passage 48 in the section. A coupling mechanism 54 extends perpendicularly from the annular wall 46 for connecting a separate device to the air intake opening 52.

The coupling mechanism 54 includes an annular flange or tube extending generally perpendicular from the annular wall 46 and surrounding the opening 52. A plurality of external mechanical threads or first threads 58 are formed on an exterior surface of the tube 56 of the coupling mechanism 54. The passage 60 extends through the tube 56 communicating with the opening 52 and hence the interior passage 48 of the nozzle section 40. Various possible separate devices that are attachable to the coupling mechanism 54 are described in greater detail below.

Figure 2B:
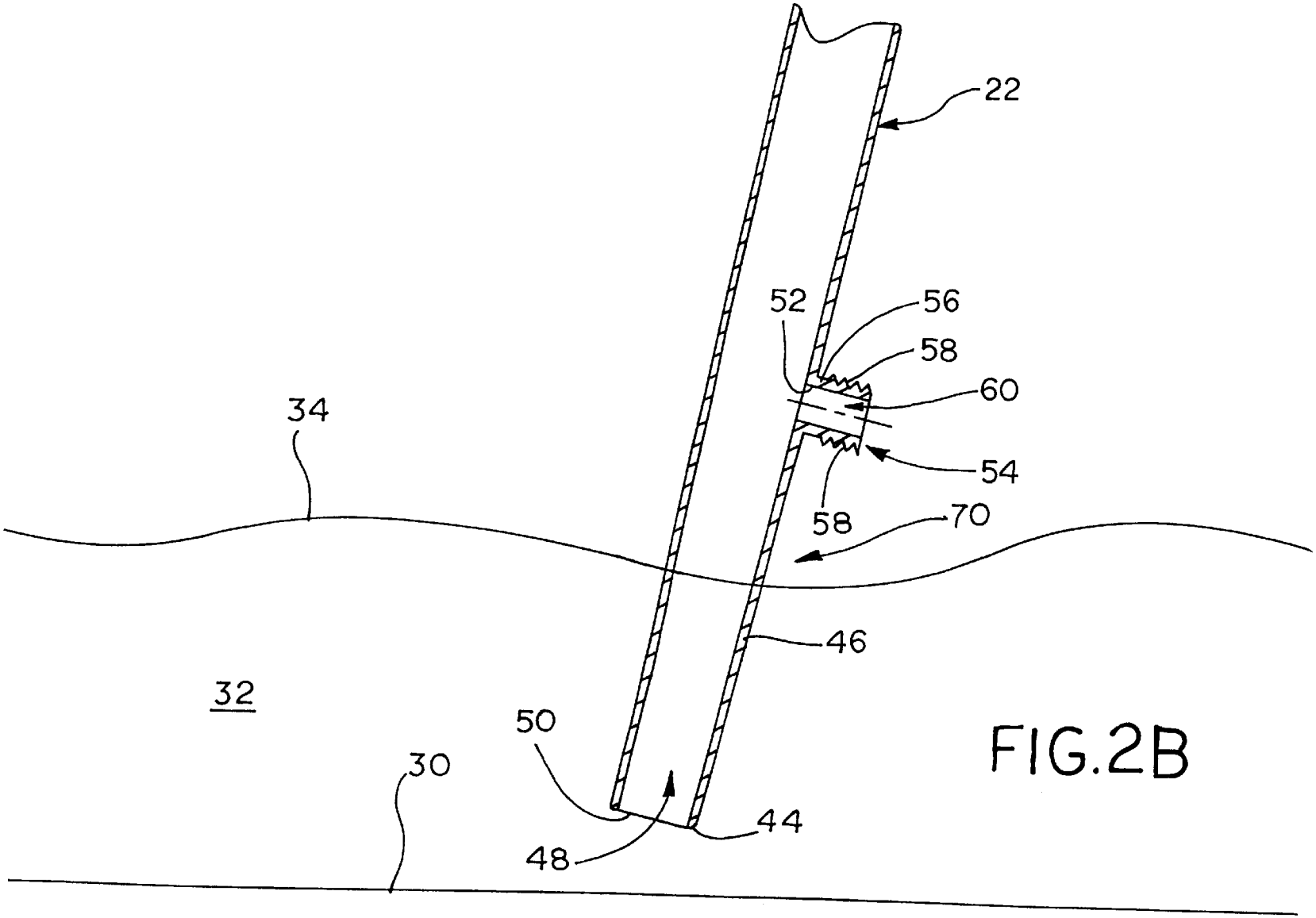
FIG. 2B is an enlarged cross section of an alternative nozzle section integrally formed as part of the vacuum hose.

FIG. 2B illustrates an alternative nozzle section 70 formed as an integral portion of the inlet end of the vacuum hose 22. The nozzle section 70 is essentially identical to the section 40 described above except that it is not a separate detachable component, but instead is formed integral with the end of the hose 22 or extension 28. It is typical for a wet/dry vacuum cleaner for the entire vacuum hose 22 to be removable from the vacuum cleaner. A separate vacuum hose 22 including the nozzle section 70 of the invention can therefore be provided in order to replace the entire hose of the vacuum cleaner including another different type of nozzle or inlet end.

Figure 3:
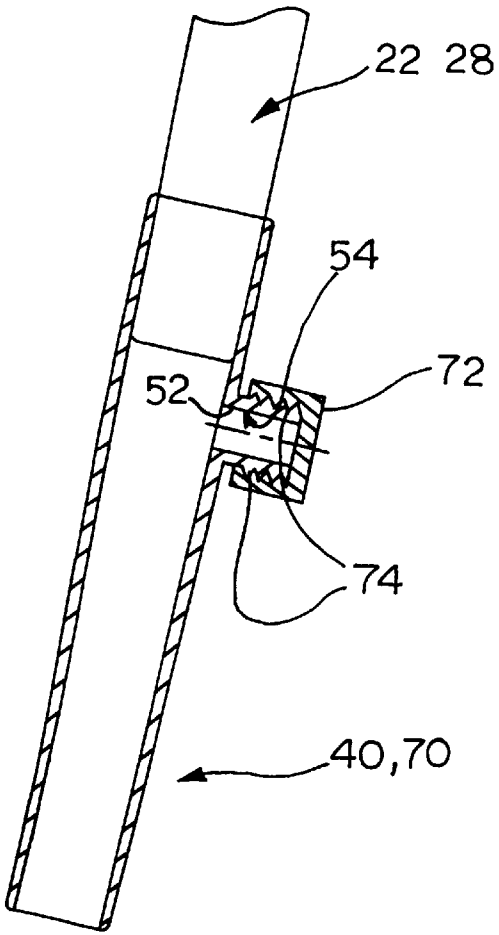
FIG. 3 is an enlarged view of the nozzle section shown in FIG. 2A and including a closure seal closing off the air intake of the nozzle section shown in FIG. 2A.

FIG. 3 illustrates the nozzle section 40 including a closure or cap 72 received over the coupling mechanism 54 of the air intake opening 52. In one disclosed example, the cap 72 has a plurality of internal mechanical second threads 74 that correspond with the external threads 58 of the tube 56 of the mechanism 54. The cap 72 is threaded onto the mechanism 54 to close off the opening 52 preventing air from entering the air intake. In this manner, the air intake can be closed off when not needed in order to collect smaller volumes of a liquid or when collecting other media. The cap 72 is just one example of various separate devices that can be attachable to the coupling mechanism 54.

Figure 4:
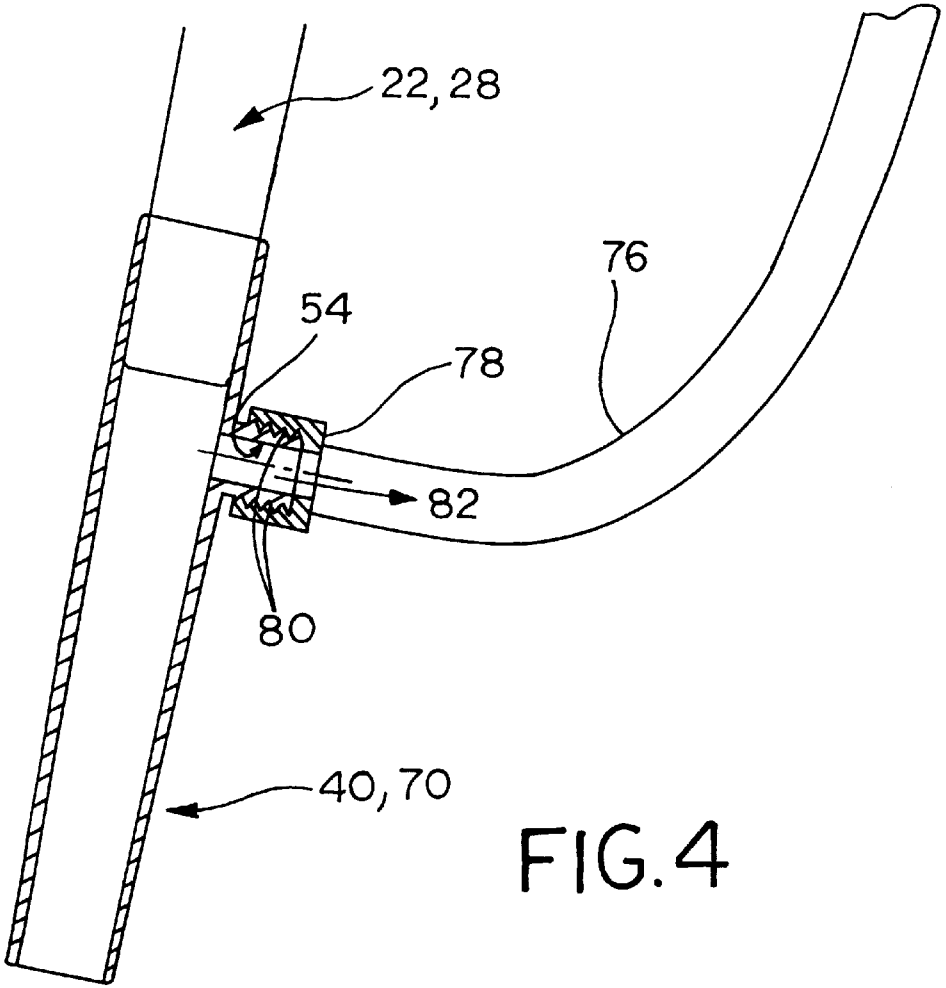
FIG. 4 is an enlarged view in cross section of the nozzle section with a secondary hose attached to the air intake.

FIG. 4 shows another example of a separate device in the form of a secondary hose 76. The secondary hose 76 can include a connector 78 with internal second threads 80 for attachment to the coupling mechanism 54 as described above. In this disclosed example, the connector 78 and the hose 76 define a passage 82 in fluid communication with the passage 60 of the coupling mechanism 54.

Figure 5:
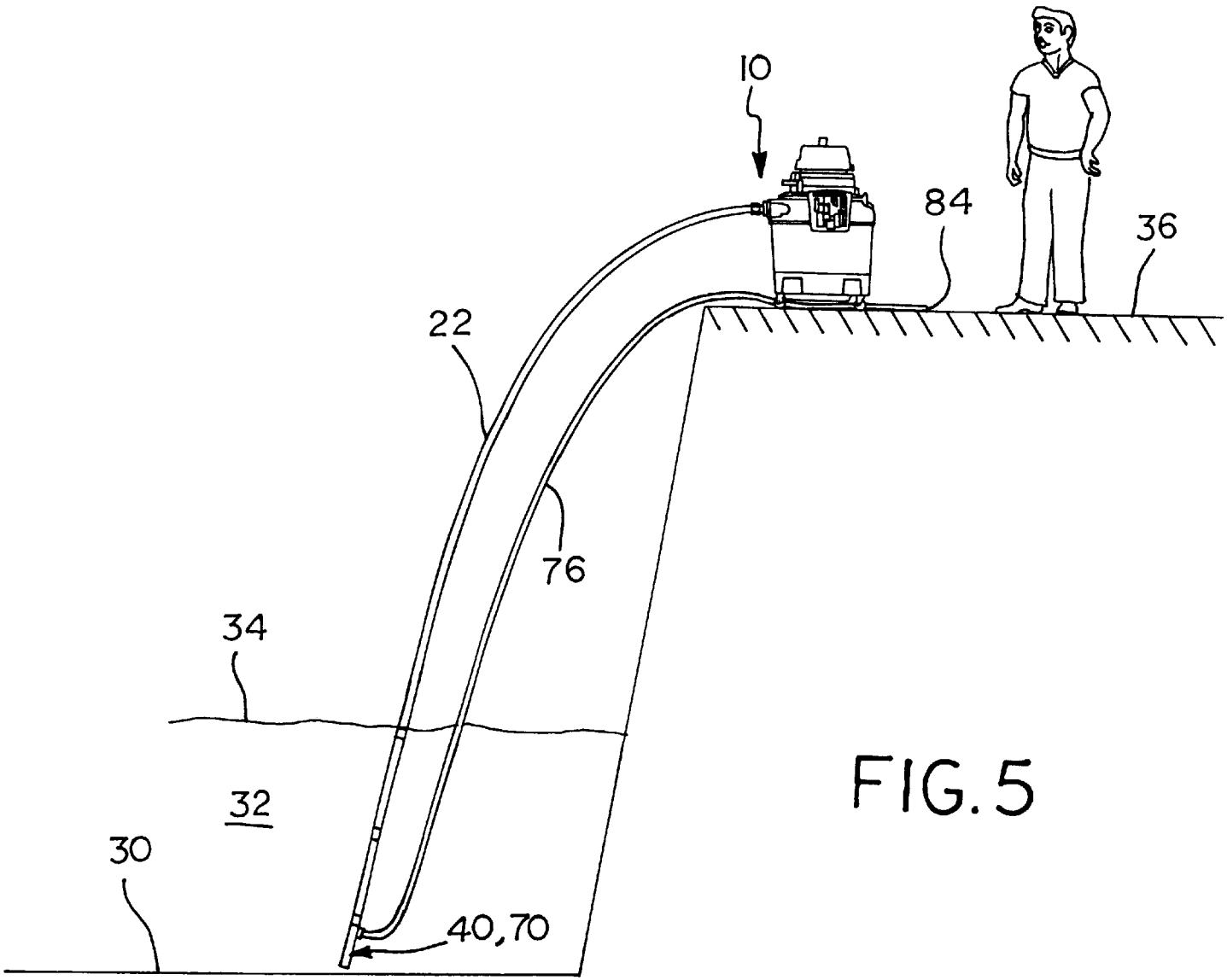
FIG. 5 is a perspective view of the vacuum cleaner with the secondary hose attached to the nozzle section as shown in FIG. 4.

FIG. 5 illustrates a perspective view of the secondary hose 76 in use. The secondary hose 76 provides a remote air intake 84 that can be positioned where necessary in order to draw atmospheric air into the secondary hose and deliver air to the nozzle section. The disclosed example illustrated in FIGS. 4 and 5 is particularly useful when the liquid level 34 is particularly high.

The air opening 52, the coupling mechanism 54, and/or the separate attachment can also be provided with an adjustable orifice or air flow controller 90, shown only schematically in the drawings. The flow controller can be manipulated to permit full air flow, no air flow or an adjustable air flow through the opening 52. The flow controller 90 permits adjustment of the air quantity or volume admitted into the hose, depending on the amount required for a particular collection job to adjust the air/liquid mixture ratio. The flow controller can be an adjustable valve, a slidable closure or any other type of suitable device that can be manipulated to open or to partially or completely close off the air flow. The controller 90 can also be provided on the distal end of the secondary hose 76, if desired, to remotely control the intake air flow.

Figure 6:
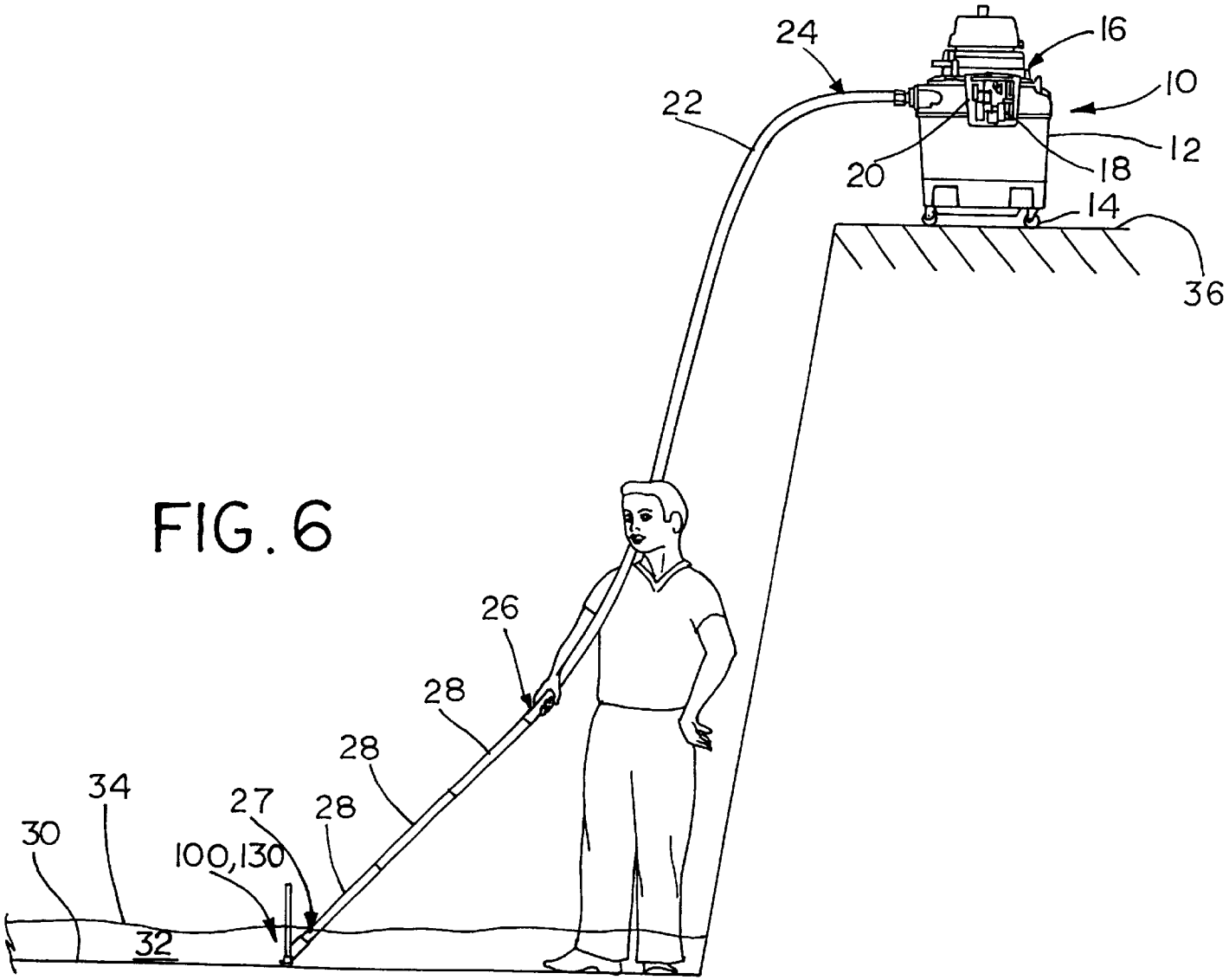
FIG. 6 is a perspective view of a vacuum cleaner in accordance with another disclosed example of the present invention.

FIG. 6 is a perspective view of another possible wet/dry vacuum cleaner constructed in accordance with the teachings of the present invention. The vacuum cleaner 10 is essentially identical to the vacuum described above with reference to FIG. 1 except for the nozzle section. FIG. 6 illustrates a nozzle section 100 that functions similar to a snorkel for providing intake air to the vacuum hose near the media inlet.

Figure 7A:
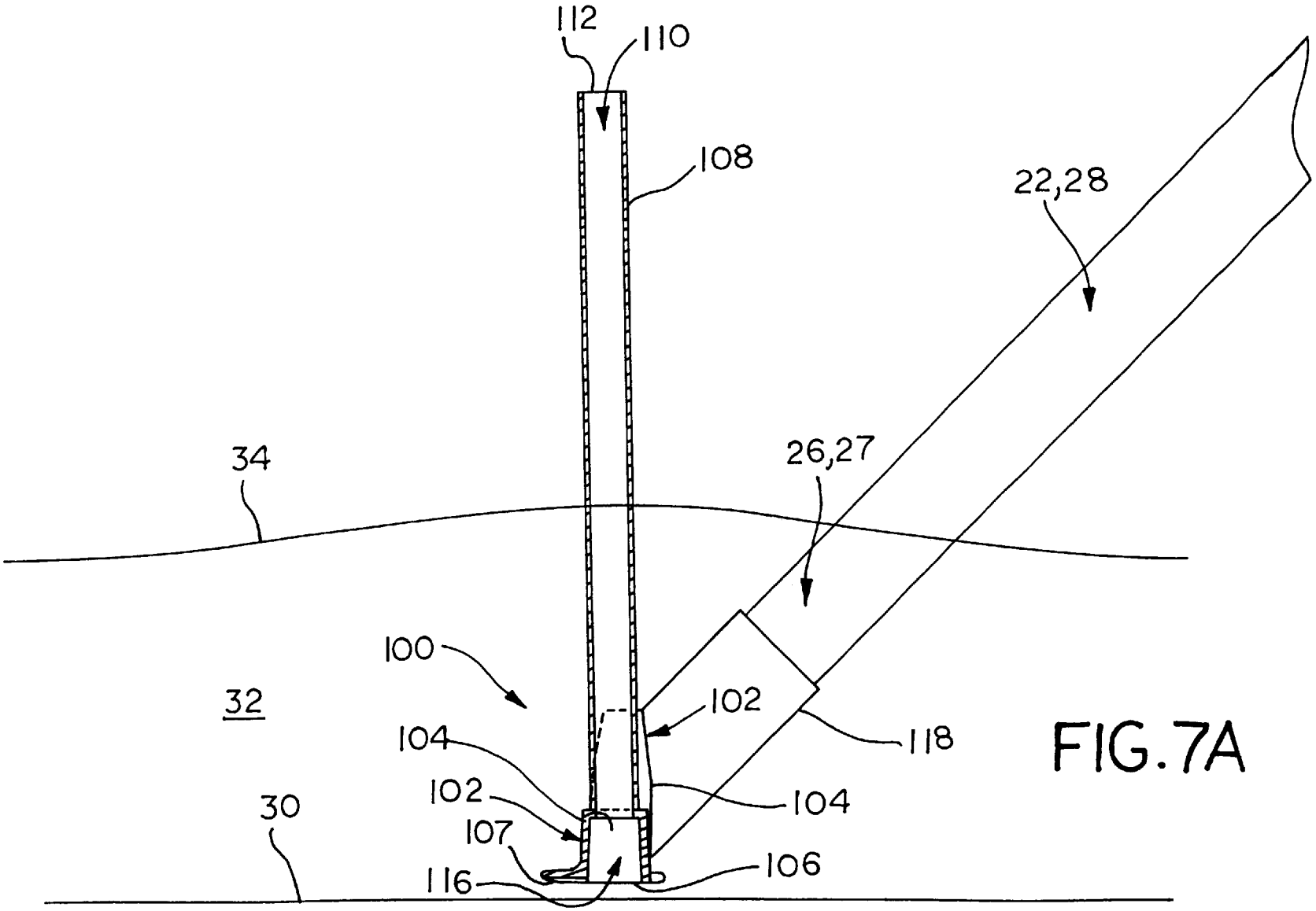
FIG. 7A is an enlarged view in cross section of a nozzle housing attached to the vacuum hose of the vacuum cleaner in FIG. 6.

FIG. 7A illustrates one possible example of the nozzle section 100. The nozzle section 100 is removable from the inlet end 26 of the vacuum hose 22 or an inlet end 27 of a hose extension 28. The nozzle section 100 generally includes a housing or shell 102 having an exterior wall 104 with an open shell bottom 106 and at least a vertical portion 107 in the wall 104 adjacent the open bottom. The vertical portion 107 in the wall permits the media to be collected to enter the shell 102 even when the bottom opening of the section 100 is rested on a surface. The open bottom 106 and the vertical portion 107 together define the media inlet of the nozzle section 100 for directing a collected media into the hose 22 or extension 28.

The nozzle section 100 also has an upstanding elongate tube 108 that, in one disclosed example, extends generally vertically when the nozzle section is properly positioned on or near a surface. The tube 108 defines an air passage 110 and has an air intake 112 at a distal end of the tube. A proximal end of the tube 108 is attached to the shell 102 and communicates with an opening 114 in the shell. Air enters the intake 112 and travels along the passage 110, exiting the tube at the opening 114 where it enters the nozzle section shell 102. The shell 102 defines an interior chamber 116 that is in fluid communication with a connector section 118 of the shell. In the example shown in FIG. 7A, the connector section 118 removably connects the nozzle section 100 to the inlet end 26 of the hose 22 or to the inlet end 27 of a hose extension 28.

In one possible example, the elongate tube 108 can be formed as an integral part of the shell 102 such as in a one-piece molded construction. Alternatively, the elongate tube can be formed as a separate and discrete element that is removably attached to the shell 102. The disclosed elongate tube can be provided in several lengths so that a user may attach a tube having an appropriate length for a particular job. In another example, though not shown in the drawing figures, the elongate tube 108 could also be replaced by a secondary hose such as the hose 76 shown in the prior disclosed example.

Figures 7B, 8:
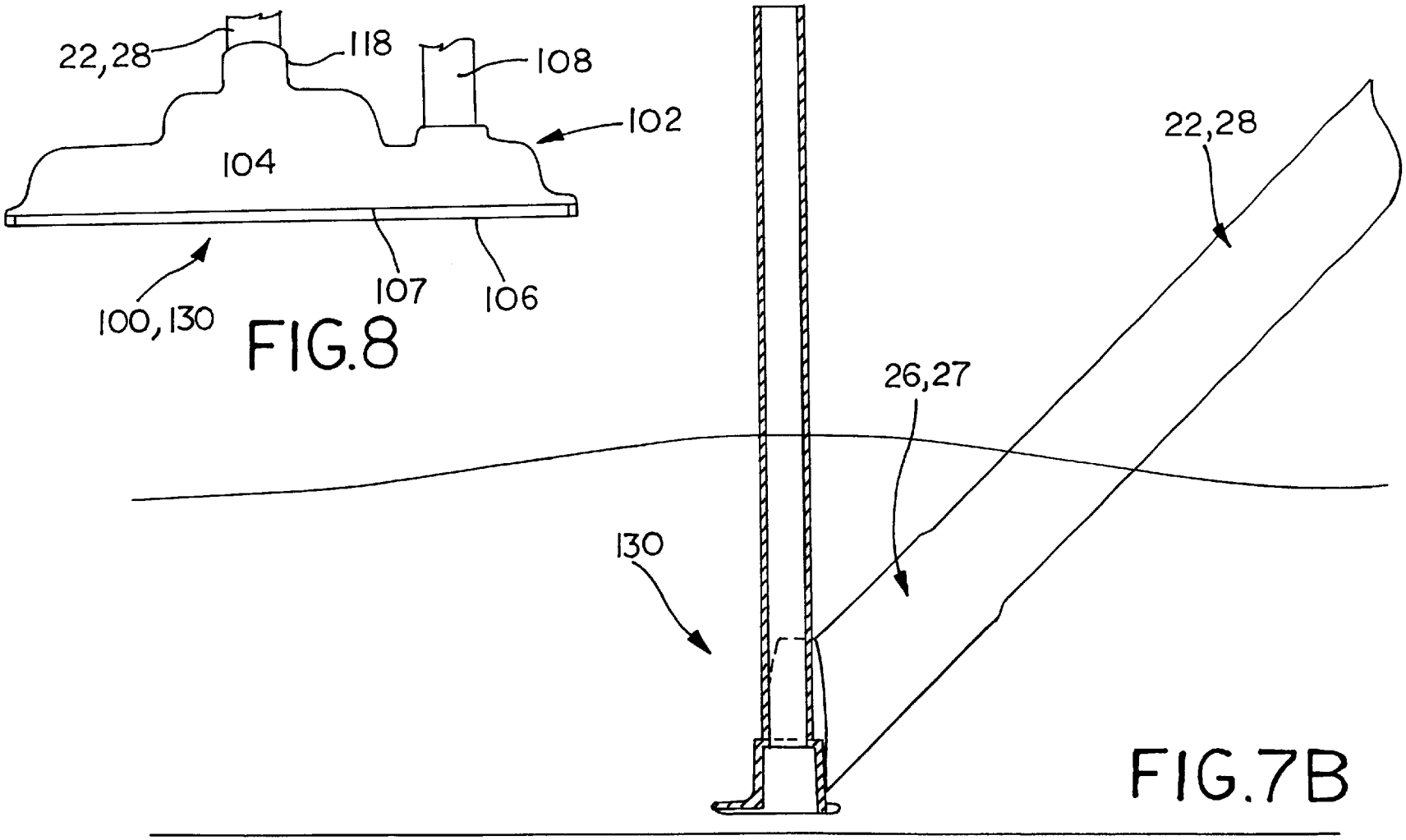
FIG. 7B is an enlarged view in cross section of an alternative disclosed example of the nozzle housing in FIG. 7A but formed integral with the vacuum hose.
FIG. 8 is a front view of the nozzle housing shown in FIG. 7A.

FIG. 7B illustrates an alternative example of a nozzle section 130. All of the components of the section are essentially the same as those shown in the example of FIG. 7A except that the section 130 is integrally formed as part of a hose extension 28 or as part of a vacuum hose 22. An entire vacuum hose and nozzle section can be replaced on the vacuum cleaner 10 when needed for a particular liquid collection job and can be stored when not needed.

Though not shown, the opening 114 in the shell 102 of either section 100 or 130 can also be provided with a coupling mechanism for receiving a cap to close off the opening or to attach a secondary hose to create a remote air intake as described for the prior example of the nozzle sections 40 and 70. Similarly, a flow controller can be provided on the nozzle sections 100 or 130 for selectively controlling the amount of air admitted into the vacuum hose, also as described above as the flow controller 90. The controller can be added at the shell intake or the distal end of the tube, for example.

FIG. 8 illustrates an exemplary front view of a nozzle section 100 or 130 illustrating one of many possible configurations of the section including the shell 102. As will be evident to those skilled in the art, the nozzle section can vary considerably in size, shape and configuration. Similarly, the nozzle sections 40 and 70 described previously can also vary considerably in shape, size and configuration as well. The materials and manufacturing methods utilized to create the nozzle sections of the invention can also vary considerably and yet fall within the scope of the invention.

In use, the apparatus and method according to the teachings of the present invention provide a number of significant advantages over a conventional wet/dry vacuum cleaner and also over prior art air mixing apparatuses. A conventional wet/dry vacuum cleaner is used to collect liquids by simply immersing the vacuum hose inlet in a liquid and collecting a liquid. The liquid lift height of a conventional vacuum cleaner is limited by the applied vacuum provided by the motor and impellers of the machine. The vacuum cleaner nozzle sections of the present invention provide a significant increase in the liquid lift height capability without changing any of the major components of the machine.

In addition, a prior art air mixing apparatus, such as for the sludge collecting machines described above, includes an air opening disposed above but near the sludge inlet permitting air to enter the hose to somewhat aerate sludge collected in the hose. A user must carefully place the inlet end of the hose in the sludge and yet avoid immersing the air opening in the media such as the sludge. In contrast, the nozzle sections described herein permit a user to immerse the nozzle section in the liquid to be collected without paying careful attention to how deep the nozzle is immersed.

The nozzle sections 40 and 70 that have an attached secondary hose 76 can simply be immersed in the liquid at virtually any depth and even rested on the surface 30. The remote air intake will admit air into the hose 76 and hence into the nozzle section regardless of how deep the nozzle section is immersed. Similarly, the nozzle sections 100 and 130 can be rested on a surface 30 as long as the length of the elongate tube 108 extends upward above the top surface 34 of the collected liquid 32. As shown in FIGS. 1–3, the nozzle sections 40 and 70 can also be utilized without a cap or a secondary hose if desired. The opening 52 of the air intake will admit air as long as the opening is not immersed in the liquid. However, the nozzle sections 40 and 70 can be adapted to incorporate the separate devices if so desired. Similarly, the nozzle sections 100 and 130 can be utilized without the attached tube or an attached secondary hose as long as the opening 114 in the housing 102 is not immersed in the liquid.

It is commonly known that a vacuum hose can be used with or without extensions, such as the extensions 28 shown in the drawing figures. Throughout this description, it is therefore intended that the inlet end and the vacuum hose discussed herein and recited in the claims refer to either the hose 22 and its inlet end 26 or to a hose extension 28 and its inlet end 27.

The air intake in each disclosed example is constructed and arranged to admit air into the vacuum hose when the media inlet is submerged in a liquid. The air intake that initially collects air is positioned somewhat remote from the media inlet so that the air intake is exposed to air when the media inlet is immersed to various and possibly substantial liquid depths. The air is delivered from the remote intake to the vacuum hose and enters the hose spaced from, but somewhat or relatively adjacent the media inlet so that the air can mix with liquid collected within the vacuum hose at a location that does not prevent the collected liquid within the vacuum hose from being lifted to the tank by the vacuum motor assembly. In other words, the air delivery point may or may not be the same as the location of the actual remote air intake. The air delivery point to the vacuum hose can therefore, for example, essentially be almost directly adjacent or next to the media inlet. Alternatively, the air delivery point into the hose can be spaced quite a distance from the media inlet. However, the air delivery point must be at a distance from the media inlet that is less than the maximum pump capacity of the motor assembly. To illustrate, if the motor assembly is capable of producing 50 in. $H_2O$ of vacuum, the air delivery point into the hose should be less than 50 inches from the media inlet for collecting water. If the air delivery point were 60 inches above the media inlet and the hose orientated vertically, water would only be lifted 50 inches, or 10 inches short of the introduced air. The air would not mix with the collected liquid and the vacuum would fail to lift any liquid to the tank. Therefore, as used herein, the terms "near", "somewhat adjacent", "relatively adjacent" or the like can be any value up to the vacuum motor pump capacity.

The forgoing detailed description has been given for clearness of understanding only, and no unnecessary limitations should be understood from the description of the exemplary devices and methods. Modifications can be made to the disclosed examples that would be obvious to those skilled in the art. These changes and modifications are intended to fall within the scope of the invention. The invention is only to be limited by the scope of the appended claims.

What is claimed is:

1. A vacuum cleaner capable of collecting a wet or a dry media, the vacuum cleaner comprising:

a vacuum hose having an inlet end and having an outlet end coupled to the vacuum cleaner;

a motor assembly supported by a portion of the vacuum cleaner for applying a vacuum to the outlet end of the vacuum hose;

a nozzle section on the inlet end of the vacuum hose;

a media inlet defined by the nozzle section and in fluid communication with the inlet end of the vacuum hose; and an intake device having an air intake for collecting air remote from the media inlet and for admitting the collected air into the vacuum hose relatively near the media inlet to mix with a collected media, the air intake selectively positionable remote from the vacuum hose.

2. The vacuum cleaner according to claim 1, wherein at least a portion of the intake device is provided on the nozzle section.

3. The vacuum cleaner according to claim 1, wherein the nozzle section is selectively detachable and connectable to the inlet end of the vacuum hose.

4. The vacuum cleaner according to claim 1, wherein the nozzle section is a non-removable end part of the vacuum hose.

5. The vacuum cleaner according to claim 1, wherein the intake device further comprises:

an elongate tube extending from the nozzle section and having a passage in fluid communication with the vacuum hose and having a distal end defining the air intake remote from the media inlet.

6. The vacuum cleaner according to claim 5, wherein the elongate tube and the nozzle section are integrally formed as a one-piece unitary structure.

7. The vacuum cleaner according to claim 5, wherein the elongate tube is selectively detachable from and insertable into an opening in the nozzle section.

8. The vacuum cleaner according to claim 1, wherein the intake device comprises a secondary elongate hose extending from the vacuum hose, the elongate hose having a distal end providing the air intake remote from the media inlet and in fluid communication with the vacuum hose.

9. The vacuum cleaner according to claim 8, wherein the intake device further comprises:

an opening formed through a wall of the nozzle section wherein the elongate hose extends from the nozzle section adjacent the opening.

10. The vacuum cleaner according to claim 1, wherein the air intake further comprises:

an opening provided in fluid communication with the vacuum hose; and a coupling mechanism cooperating with the opening for selectively attaching, removing and replacing a separate device relative to the opening.

11. The vacuum cleaner according to claim 10, wherein the separate device is a closure seal to selectively close off the opening of the air intake.

12. The vacuum cleaner according to claim 10, wherein the coupling mechanism comprises:

a plurality of first mechanical threads provided adjacent the opening of the nozzle section; and a plurality of second mechanical threads provided on a portion of the separate device that correspond to the first mechanical threads.

13. The vacuum cleaner according to claim 1, further comprising:

an air flow controller coupled to a portion of the vacuum cleaner for controlling the amount of air entering the vacuum hose through the air intake.

14. The vacuum cleaner according to claim 1, wherein the air intake is constructed and arranged to admit air into the vacuum hose when the media inlet is submerged in a liquid and so that the air can mix with liquid collected within the vacuum hose at a location preventing the collected liquid from forming a column of liquid in the vacuum hose that cannot be lifted to the tank by the vacuum motor assembly.

15. A nozzle section for an inlet end of a vacuum hose of a vacuum cleaner capable of collecting wet or dry media, the nozzle section comprising:

a proximal end communicating with the inlet end of the vacuum hose;

a distal end disposed generally opposite the proximal end and defining a media inlet for directing media to be collected into the vacuum hose;

an air opening through a portion of the nozzle section and spaced a distance from the media inlet; and a coupling mechanism cooperating with the air intake for selectively attaching, removing and replacing a separate device relative to the air intake.

16. The nozzle section according to claim 15, wherein the vacuum hose and the nozzle section are discrete components and wherein the nozzle section can be removed from the vacuum hose.

17. The nozzle section according to claim 15, wherein the coupling mechanism includes a plurality of first mechanical threads carried on a portion of the air intake, and wherein the separate device includes a plurality of second mechanical threads that correspond to the first mechanical threads for attaching and removing the separate device.

18. The nozzle section according to claim 15, wherein the separate device includes at least a removable secondary elongate hose having a distal end that defines a remote air intake in fluid communication with the opening in the nozzle section.

19. The nozzle section according to claim 15, wherein the separate device includes a closure for sealing off the opening in the nozzle section.

20. A nozzle section for an inlet end of a vacuum hose of a vacuum cleaner capable of collecting wet or dry media the nozzle section comprising:

a connector communicating with the inlet end of the vacuum hose;

a distal end defining a media inlet for directing media to be collected into the vacuum hose; and an elongate tube extending from the nozzle section, the elongate tube having a proximal end connected to the nozzle section, a distal end opposite and spaced from the proximal end and the vacuum hose, and an air intake formed in the distal end that is in fluid communication with the vacuum hose via the elongate tube and the nozzle section.

21. The nozzle section according to claim 20, wherein the nozzle section is molded as a one-piece integral structure and is selectively detachable and connectable to the inlet end of the vacuum hose.

22. The nozzle section according to claim 20, wherein the elongate tube is selectively detachable from and insertable into an opening in the nozzle section.

23. A method of collecting a liquid using a wet/dry vacuum cleaner that has an elongate vacuum hose extending from the vacuum cleaner a media inlet on a distal end of the vacuum hose, a motor assembly supported by a portion of the vacuum cleaner for applying a vacuum to the vacuum hose, and a tank for collecting media from the vacuum hose, the method comprising the steps of:

providing an intake device with a remote air intake spaced a distance from the media inlet for admitting air into the vacuum hose relatively adjacent the media inlet, the air intake selectively positionable remote from the vacuum hose;

immersing the distal end of the vacuum hose in the liquid to be collected so that the media inlet is immersed in the liquid and so that the air intake is exposed to atmospheric air; and applying a vacuum to the vacuum hose to collect the liquid through the media inlet while drawing air via the air intake into the vacuum hose to mix with the collected liquid.

24. The method according to claim 23, wherein the step of providing further comprises:

providing a nozzle section on a portion of the vacuum hose defining the media inlet and at least a portion of the intake device.

25. The method according to claim 24, further comprising the step of:

providing an elongate tube as the intake device to a portion of and extending from the nozzle section so that the elongate tube is in fluid communication with the vacuum hose and that a distal end of the tube defines the air intake remote from the media inlet.

26. The method according to claim 4, further comprising the step of:

providing a secondary elongate hose as the intake device extending from the vacuum hose so that a distal end of the elongate hose provides the air intake remote from the media inlet and in fluid communication with the vacuum hose.

* * * * *

UNITED STATES PATENT AND TRADEMARK OFFICE

CERTIFICATE OF CORRECTION

PATENT NO. : 6,440,227 B1 
DATED : August 27, 2002
INVENTOR(S) : Robert C. Berfield & Alan D. Kaufman It is certified that error appears in the above-identified patent and that said Letters Patent is hereby corrected as shown below:

Column 10,
Line 51, please delete “wet or dry media the” and insert -- wet or dry media, the --.

Column 11,
Line 6, please delete “vacuum cleaner a media” and insert -- vacuum cleaner, a media --.

Signed and Sealed this

Eighth Day of April, 2003

JAMES E. ROGAN
*Director of the United States Patent and Trademark Office*